US012527385B2

(12) United States Patent
Park et al.

(10) Patent No.: US 12,527,385 B2
(45) Date of Patent: Jan. 20, 2026

(54) CORDLESS HAIR STRAIGHTENER HAVING DUAL HIDDEN HINGE STRUCTURE

(71) Applicant: MANGOSLAB CO., LTD., Seongnam (KR)

(72) Inventors: Yong Shik Park, Yongin-si (KR); Sang Bong Lee, Ansan-si (KR)

(73) Assignee: MANGOSLAB CO., LTD., Seongnam (KR)

( * ) Notice: Subject to any disclaimer, the term of this patent is extended or adjusted under 35 U.S.C. 154(b) by 333 days.

(21) Appl. No.: 18/379,376

(22) Filed: Oct. 12, 2023

(65) Prior Publication Data

US 2024/0032664 A1 Feb. 1, 2024

Related U.S. Application Data

(63) Continuation of application No. PCT/KR2021/011566, filed on Aug. 30, 2021.

(30) Foreign Application Priority Data

Apr. 15, 2021 (KR) ..... 10-2021-0048916
Apr. 15, 2021 (KR) ..... 10-2021-0048922

(51) Int. Cl.
*A45D 2/00* (2006.01)

(52) U.S. Cl.
CPC ..... *A45D 2/001* (2013.01)

(58) Field of Classification Search
CPC ... A45D 1/00; A45D 1/02; A45D 1/04; A45D 1/06; A45D 1/08; A45D 1/14; A45D 1/20;

(Continued)

(56) References Cited

U.S. PATENT DOCUMENTS

2010/0089413 A1* 4/2010 Wright ..... A45D 2/001 132/211
2011/0247647 A1* 10/2011 Kim ..... A45D 1/04 132/269

(Continued)

FOREIGN PATENT DOCUMENTS

CN 201431079 3/2010
CN 111671218 A 9/2020

(Continued)

OTHER PUBLICATIONS

Jul. 26, 2024—European Search Report—App No. 21937078.0.

*Primary Examiner* — Rachel R Steitz
*Assistant Examiner* — Karim Asqiriba
(74) *Attorney, Agent, or Firm* — Banner & Witcoff, Ltd.

(57) ABSTRACT

According to an embodiment of the present disclosure, a cordless hair straightener includes a body which includes a battery including an input and an output and charged by an external power supply through the input, a first heater unit and a second heater unit which are electrically connected to the output of the battery, a first housing which accommodates at least a part of the body and at least a part of the first heater unit therein and moves the first heater unit between a closed position and an open position, and a second housing which accommodates at least a part of the body and at least a part of the second heater unit therein and moves the second heater unit between a closed position and an open position.

17 Claims, 16 Drawing Sheets

(58) Field of Classification Search
CPC . A45D 1/28; A45D 2/00; A45D 2/001; A45D 2/40; A45D 20/48; A45D 40/221
See application file for complete search history.

(56) References Cited

U.S. PATENT DOCUMENTS

| | | | | |
|---|---|---|---|---|
| 2013/0098389 | A1 | 4/2013 | Uwano | |
| 2015/0216280 | A1 | 8/2015 | Sayers et al. | |
| 2017/0238680 | A1 | 8/2017 | Kim | |
| 2024/0298767 | A1* | 9/2024 | Zhou | A45D 1/04 |

FOREIGN PATENT DOCUMENTS

| | | | |
|---|---|---|---|
| KR | 10-2010-0125609 | A | 12/2010 |
| KR | 10-1581442 | | 1/2016 |
| KR | 10-2019-0012390 | A | 2/2019 |
| WO | 2020/141295 | A1 | 7/2020 |

* cited by examiner (a)

(b)

CORDLESS HAIR STRAIGHTENER HAVING DUAL HIDDEN HINGE STRUCTURE

CROSS-REFERENCE TO RELATED APPLICATION

The present application is a continuation of International Patent Application No. PCT/KR2021/011566, filed on Aug. 30, 2021, which is based upon and claims the benefit of priority to Korean Patent Application Nos. 10-2021-0048916, filed on Apr. 15, 2021, and 10-2021-0048922, filed on Apr. 15, 2021. The disclosures of the above-listed applications are hereby incorporated by reference herein in their entirety.

TECHNICAL FIELD

The present disclosure relates to a cordless hair straightener, and more specifically, to a cordless hair straightener having a hidden hinge structure which allows a housing to be easily attached and detached and not exposed to the outside when the housing is attached.

BACKGROUND

Most related hair straighteners are wired hair straighteners which are connected by a wire at a lower end for power supply. When in use, the hair straightener is frequently moved or rotated, during which the wire often interferes with the movements of the hair straightener, which is quite problematic. In order to solve this problem, cordless hair straighteners have recently been developed.

For the hair straighteners, a hinge structure is generally used for allowing the movements of the upper and lower arms, but such hinge structure has a problem of being exposed to the outside, deteriorating aesthetics and it is also directly exposed to external shocks. Further, when connecting to a charging wire for use, there is a problem in that the wire hinders the movements of the hair straightener.

Further, as the hair straightener is repeatedly moved between an open position and a closed position, the internal wires are put under strain, which causes the wires to be easily worn out. Further, because a handle of the hair straightener should be sized so that it can be easily held in one hand for use, this should be taken into consideration when designing wiring structure.

SUMMARY

In order to solve one or more problems (e.g., the problems described above and/or other problems not explicitly described herein), the present disclosure provides a cordless hair straightener.

The cordless hair straightener may include a body which includes a battery including an input and an output and charged by an external power supply through the input, a first heater unit and a second heater unit which are electrically connected to the output of the battery, a first housing which accommodates at least a part of the body and at least a part of the first heater unit therein and moves the first heater unit between a closed position and an open position, and a second housing which accommodates at least a part of the body and at least a part of the second heater unit therein and moves the second heater unit between a closed position and an open position.

The first housing may be engaged with a first hinge disposed in a lower portion of the body and be movable on the first hinge between the closed position and the open position, and the second housing may be engaged with a second hinge which is different from the first hinge and disposed the lower portion of the body, and be movable on the second hinge between the closed position and the open position.

The first hinge may be accommodated in the first housing and not exposed to the outside, and the second hinge may be accommodated in the second housing and not exposed to the outside.

The first hinge may include a first protrusion having a first inclined surface and a second protrusion having a second inclined surface, the first protrusion and the second protrusion may be disposed in opposite directions on the same axis, and when external force is applied to the first inclined surface and the second inclined surface in a predetermined direction, the first protrusion may be moved in the first direction, and the second protrusion may be moved in the second direction opposite to the first direction, allowing the first housing to be attached and detached.

The body may include a guide hole on a lower side surface, and when pressurizing equipment is inserted along the guide hole, the protrusions of the first hinge may be retracted, allowing the first housing to be attached or detached.

The cordless hair straightener may further include a swivel assembly connected to a cable that supplies external power supply, in which the body may include a guide hole and a charging terminal on a lower side surface, the swivel assembly may be fixedly coupled with the body through the guide hole, and the swivel assembly may electrically connect the cable and the charging terminal, while allowing infinite rotation of the body without twisting the cable.

The swivel assembly may include an upper assembly fixedly coupled with the body, a lower assembly coupled with the cable, and a cable fixing member fixing the cable so as not to be separated.

The cordless hair straightener may further include a charging cradle including a magnet disposed in a lower portion of the body, a hall effect sensor, an output terminal configured to contact the input, and a controller that controls application of external power supply to the output terminal.

The controller of the charging cradle is configured to, if the hall effect sensor does not sense the magnetic force of the magnet, block application of the external power supply to the output terminal so as to prevent a short circuit due to short of the output terminal, and if the hall effect sensor senses the magnetic force of the magnet, start applying the external power supply to the output terminal.

The controller of the charging cradle may be further configured to, if the hall effect sensor senses the magnetic force of the magnet, gradually increase amount of power applied to the output terminal, thereby preventing a generation of sparks in an incomplete contact state.

An elastic member may be disposed between the first housing and the body, and an elastic member may be disposed between the second housing and the body.

The cordless hair straightener may further include a first wire electrically connecting the output of the battery and the first heater unit, and a second wire electrically connecting the output of the battery and the second heater unit.

The input of the battery may be disposed in the lower portion of the body, the output of the battery may be disposed in an upper portion of the body, the first heater unit may be disposed so that at least a part of the lower side surface faces at least a part of the upper side surface of the body, the second heater unit may be disposed so that at least a part of the lower side surface faces at least a part of the upper side surface of the body, one end of the first wire may be connected to the output of the battery, and the other end of the first wire may be connected to the upper side portion of the first heater unit, one end of the second wire may be connected to the output of the battery, and the other end of the second wire may be connected to the upper side portion of the second heater unit.

At least a part of the first wire may be located between the first housing and the first heater unit, and at least a part of the second wire may be located between the second housing and the second heater unit.

The first heater unit may include a first recess in which the first wire located between the first housing and the first heater unit is disposed, and the second heater unit may include a first recess in which the second wire located between the second housing and the second heater unit is disposed.

The body may include a first accommodating unit accommodating at least a part of the first wire and a second accommodating unit accommodating at least a part of the second wire, and the first accommodating unit and the second accommodating unit may be formed in the upper portion of the body.

The part of the first wire accommodated in the first accommodating unit includes at least one bent curved portion, and the part of the second wire accommodated in the second accommodating unit includes at least one bent curved portion.

The part of the first wire accommodated in the first accommodating unit may include a plurality of bent curved portions to prevent disconnection of the first wire while the first heater unit is moved between the closed position and the open position, and the plurality of curved portions of the first wire may be formed by being bent in different directions, respectively, and the part of the second wire accommodated in the second accommodating unit may include a plurality of bent curved portions to prevent disconnection of the second wire while the second heater unit is moved between the closed position and the open position, and the plurality of curved portions of the second wire may be formed by being bent in different directions, respectively.

A cordless hair straightener having dual hidden hinge structure which is aesthetically pleasing can be provided.

The tension applied to the wires is alleviated to prevent the wires from being easily worn out or cut.

The power loss of the cordless hair straightener can be minimized and the use time of a user can increase.

As the volume of the wires accommodated in the body decreases, the overall size of the body that serves as a handle of the cordless hair straightener also decreases, and as a result, user convenience also increases.

User can operate the cordless hair straightener using a DC charging cable even when the battery is not fully charged.

It is possible to prevent a situation during use in which the cordless hair straightener is separated from the cable and the lower assembly, or the power supply stops.

When the user uses the cordless hair straightener with the cable connected to the lower assembly, the cable can be prevented from being twisted.

A short circuit due to a short of the output terminal in the charging cradle can be prevented.

It is possible to prevent a generation of sparks in incomplete contact state between the output terminal and the first charging terminal of the cordless hair straightener.

The wires can be stably accommodated in the two recesses while the cordless hair straightener is moved between the open position and the closed position.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
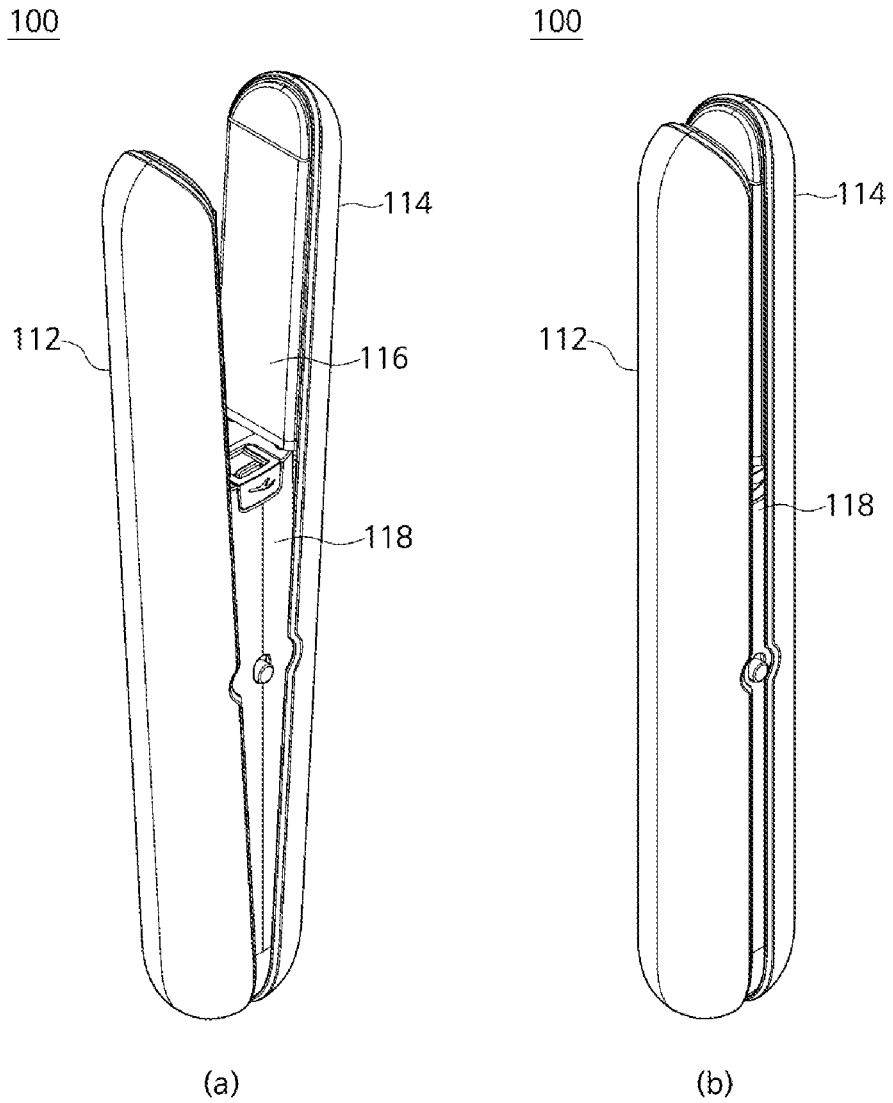
FIG. 1 are perspective views of a cordless hair straightener in an open state and a closed state.

Hereinafter, example details for the practice of the present disclosure will be described in detail with reference to the accompanying drawings. In the following description, detailed descriptions of well-known functions or configurations will be omitted if it may make the subject matter of the present disclosure rather unclear.

In the accompanying drawings, the same or corresponding components are assigned the same reference numerals. In addition, in the following description of various examples, duplicate descriptions of the same or corresponding components may be omitted. However, even if descriptions of components are omitted, it is not intended that such components are not included in any example.

Advantages and features of the disclosed examples and methods of accomplishing the same will be apparent by referring to examples described below in connection with the accompanying drawings. However, the present disclosure is not limited to the examples disclosed below, and may be implemented in various forms different from each other, and the examples are merely provided to make the present disclosure complete, and to fully disclose the scope of the disclosure to those skilled in the art to which the present disclosure pertains.

The terms used herein will be briefly described prior to describing the disclosed example(s) in detail. The terms used herein have been selected as general terms which are widely used at present in consideration of the functions of the present disclosure, and this may be altered according to the intent of an operator skilled in the art, related practice, or introduction of new technology. In addition, in specific cases, certain terms may be arbitrarily selected by the applicant, and the meaning of the terms will be described in detail in a corresponding description of the example(s). Therefore, the terms used in the present disclosure should be defined based on the meaning of the terms and the overall content of the present disclosure rather than a simple name of each of the terms.

As used herein, the singular forms "a," "an," and "the" are intended to include the plural forms as well, unless the context clearly indicates the singular forms. Further, the plural forms are intended to include the singular forms as well, unless the context clearly indicates the plural forms. Further, throughout the description, if a portion is stated as "comprising (including)" a component, it is intended as meaning that the portion may additionally comprise (or include or have) another component, rather than excluding the same, unless specified to the contrary.

Prior to describing the examples of the present disclosure, it is to be noted that the upper direction of the drawing may be referred to as "upper portion" or "upper side" of the configuration shown in the drawing, and the lower direction may be referred to as "lower portion" or "lower side". In addition, in the drawings, a portion between the upper and lower portions of the configuration shown in the drawings, or a portion other than the upper and lower portions may be referred to as "side portion" or "side". Relative terms such as "upper portion" and "upper side" may be used to describe the relationship between components shown in the drawings, and the present disclosure is not limited by these terms.

Further, the term "module" or "unit" used herein refers to a software or hardware component, and "module" or "unit" performs certain roles. However, the meaning of the "module" or "unit" is not limited to software or hardware. The "module" or "unit" may be configured to be in an addressable storage medium or configured to play one or more processors. Accordingly, as an example, the "module" or "unit" may include components such as software components, object-oriented software components, class components, and task components, and at least one of processes, functions, attributes, procedures, subroutines, program code segments, drivers, firmware, micro-codes, circuits, data, database, data structures, tables, arrays, and variables. Furthermore, functions provided in the components and the "modules" or "units" may be combined into a smaller number of components and "modules" or "units", or further divided into additional components and "modules" or "units."

The "module" or "unit" may be implemented as a processor and a memory. The "processor" should be interpreted broadly to encompass a general-purpose processor, a central processing unit (CPU), a microprocessor, a digital signal processor (DSP), a controller, a microcontroller, a state machine, and so forth. Under some circumstances, the "processor" may refer to an application-specific integrated circuit (ASIC), a programmable logic device (PLD), a field-programmable gate array (FPGA), and so on. The "processor" may refer to a combination for processing devices, e.g., a combination of a DSP and a microprocessor, a combination of a plurality of microprocessors, a combination of one or more microprocessors in conjunction with a DSP core, or any other combination of such configurations. In addition, the "memory" should be interpreted broadly to encompass any electronic component that is capable of storing electronic information. The "memory" may refer to various types of processor-readable media such as random access memory (RAM), read-only memory (ROM), non-volatile random access memory (NVRAM), programmable read-only memory (PROM), erasable programmable read-only memory (EPROM), electrically erasable PROM (EEPROM), flash memory, magnetic or optical data storage, registers, and so on. The memory is said to be in electronic communication with a processor if the processor can read information from and/or write information to the memory. The memory integrated with the processor is in electronic communication with the processor.

FIG. 1 are perspective views of a cordless hair straightener 100 in an open state and a closed state. FIG. 1A shows the cordless hair straightener 100 in an open state, and FIG. 1B shows the cordless hair straightener in a closed state. As shown, the cordless hair straightener 100 may include a first housing 112, a second housing 114, a first heater unit (not shown), a second heater unit 116, and a body 118.

The first heater unit and the second heater unit 116 may receive power supply from a battery (DC power supply, not shown) disposed in the cordless hair straightener 100. The battery may be included in the body 118. Further, the first heater unit and the second heater unit 116 may include a heating resistor (not shown) and may operate as a heating element by the power supplied from the battery and.

The first housing 112 may move the first heater unit between a closed position and an open position. Similarly, the second housing 114 may move the second heater unit 116 between a closed position and an open position. In the open position, at least a part of the body 118 located between the first housing 112 and the second housing 114 may be exposed to the outside. Meanwhile, in the closed position, the body 118 may be almost shielded by the first housing 112 and the second housing 114.

The first housing 112 and the second housing 114 may accommodate at least a part of the body 118. For example, the first housing 112 may accommodate a part of the left side of the body 118, and the second housing 114 may accommodate a part of the right side of the body 118. Additionally, the first housing 112 and the second housing 114 may accommodate at least a part of the first heater unit and at least a part of the second heater unit 116, respectively. For example, the second housing 114 may accommodate a part of the second heater unit 116 by covering all of a plurality of surfaces of the second heater unit 116 excluding at least one surface. In this case, the at least one surface of the second heater unit 116 exposed to the outside may include a surface to be in contact with the hair of a user.

Figure 2:
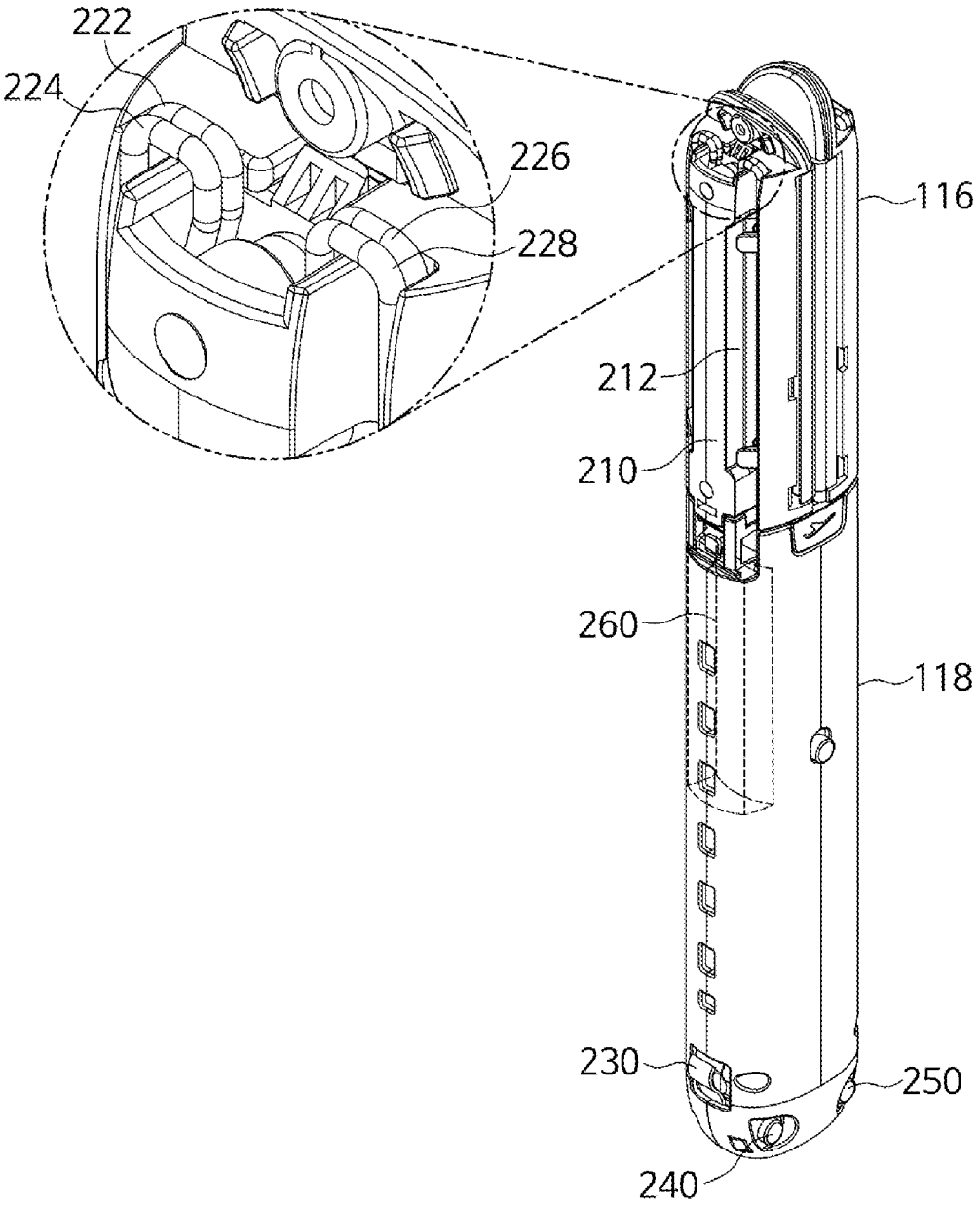
FIG. 2 is a perspective view of a cordless hair straightener with first and second housings removed.

FIG. 2 is a perspective view of the cordless hair straightener with the first housing 112 and the second housing 114 removed. The first heater unit 210 may be disposed so that at least a part of a lower side surface faces at least a part of an upper side surface of the body 118. For example, when the first heater unit 210 is in the closed position, the lower side surface of the first heater unit 210 may face a part of the upper side surface of the body 118, and when the first heater unit 210 is in the open position, a part of the lower side surface of the first heater unit 210 may face a part of the upper side surface of the body 118. Similarly, the second heater unit 116 may be disposed so that at least a part of a lower side surface faces at least a part of the upper side surface of the body 118.

The first heater unit 210 may accommodate at least a part of wires 222 to 228. For example, the wires 222 to 228 may be accommodated inside the first heater unit 210, and at least a part of the third wire 226 and the fourth wire 228 may extend to be disposed in a first recess 212 of the first heater unit 210. In FIG. 2, while only the first recess 212 accommodating the third wire 226 and the fourth wire 228 therein is shown, the first heater unit 210 may also include a second recess (not shown) that accommodates the first wire 222 and the second wire 224 therein. In addition, similarly to the first heater unit 210, the second heater unit 116 may include two recesses to accommodate at least a part of the wires located between the second heater unit 116 and the second housing 114.

The body 118 may accommodate at least a part of the wires 222 to 228 in the accommodating unit 260 formed on one side of an upper portion of the body 118. Specifically, the wires 222 to 228 disposed along the two recesses may be extended and accommodated in the accommodating unit 260. In this case, each of the wires 222 to 228 accommodated in the accommodating unit 260 may include a plurality of bent structures which will be described in detail below with reference to FIG. 4. Similarly, an accommodating unit may also be formed on the other side of the upper portion of the body 118 to accommodate at least a part of the wires connected to the second heater unit 116.

There may be a first hinge 240 and a second hinge 250 disposed on a lower portion of the body 118. The first housing 112 may be engaged with the first hinge 240 so as to be movable on the first hinge 240 between the closed position and the open position. In this process, the first heater unit 210 may be moved between the closed position and the open position together with the first housing 112. Similarly, the second housing 114 may be engaged with the second hinge 250 so as to be movable on the second hinge 250 between the closed position and the open position.

As shown, when the first hinge 240 and the first housing 112 are engaged with each other, the first hinge 240 may be accommodated in the first housing 112 and not exposed to the outside. Similarly, when the second hinge 250 and the second housing 114 are engaged with each other, the second hinge 250 may be accommodated in the second housing 114 and not exposed to the outside. With this configuration, a cordless hair straightener having a dual hidden hinge structure can be provided, in which the hinge is not exposed to the outside and which is aesthetically pleasing.

The body 118 may include an elastic member 230. Specifically, the elastic member 230 may be disposed on a lower end of the body 118 to provide elastic restoring force for the first housing 112 to be moved from the closed position to the open position. Similarly, an elastic member may be additionally disposed between the second housing 114 and the body 118.

Figure 3:
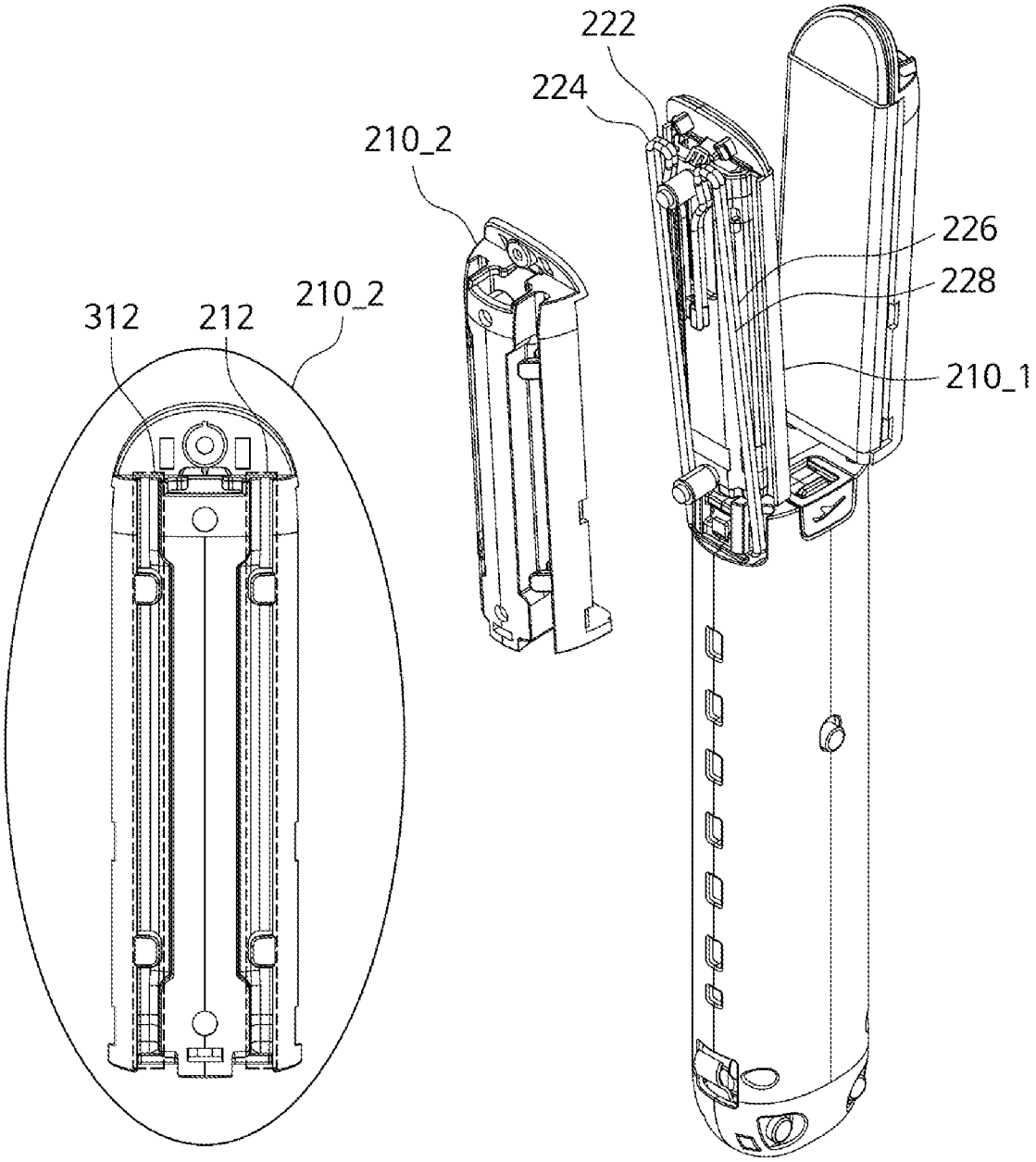
FIG. 3 is an exploded view of a first heater unit.

FIG. 3 is an exploded view of a first heater unit. The first heater unit may be disassembled into a first member 210_1 and a second member 210_2. The first member 210_1 may be a structure for accommodating/fixing a heating resistor. The second member 210_2 may include a first recess 212 and a second recess 312 for accommodating the wires 222 to 228. For example, a part of the third wire 226 and the fourth wire 228 may be accommodated in the first recess 212, and a part of the first wire 222 and the second wire 224 may be accommodated in the second recess 312.

The two recesses 212 and 312 may refer to the recessed paths for the wire disposed between the first housing 112 and the first heater unit to be received therein. For example, the two recesses 212 and 312 may be configured with appropriate width and depth so as to accommodate two wires, and accordingly, the wires 222 to 228 can be stably accommodated in the two recesses 212, 312 while the first heater unit is moved between the open position and the closed position. With this configuration, a part of the wires 222 to 228 may be disposed between the first housing 112 and the first heater unit. The second heater unit may be configured similarly to the first heater unit.

Figure 4:
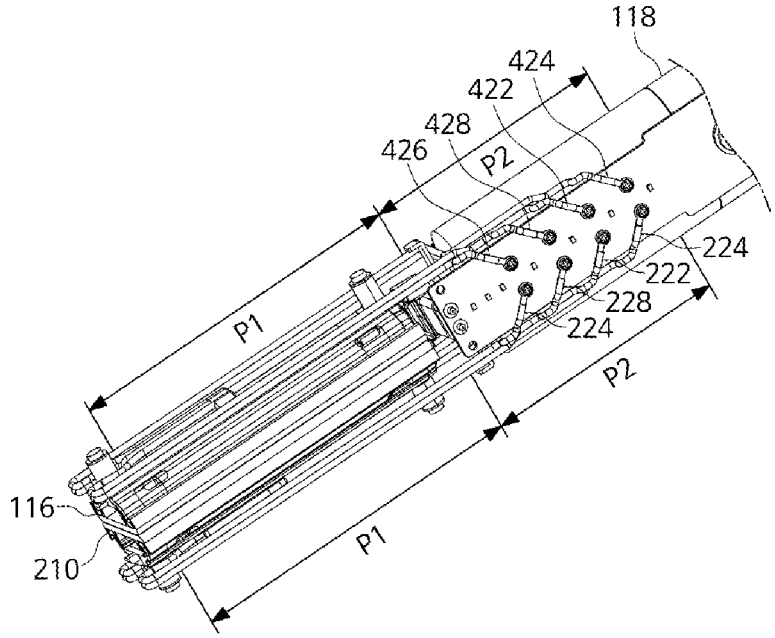
FIG. 4 are perspective views showing wire arrangement between a body and two heaters.
Figure 4:
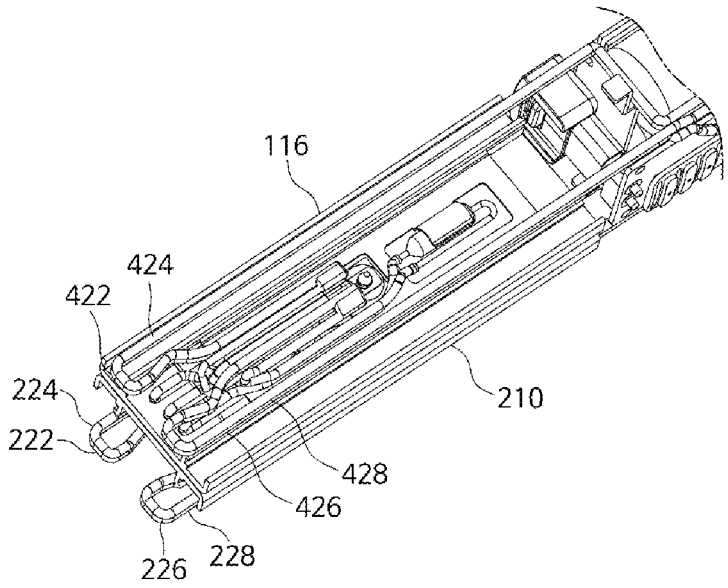

FIG. 4 are perspective views showing wire arrangement between the body 118 and the two heaters 116 and 210. FIG. 4A is a side perspective view of the two heaters 116 and 210. The first heater unit 210 may be connected to the output of the body 118 (e.g., to a main board of the body) or the output of the battery through a first set of wires 222 to 228, and the second heater unit 116 may be connected to the output of the body 118 (e.g., to the main board of the body) or the output of the battery through a second set of wires 422 to 428. A first part P1 of the first set of wires 222 to 228 may be accommodated in the two recesses of the first heater unit 210. Similarly, a first part P1 of the second set of wires 422 to 428 may be accommodated in the two recesses of the second heater unit 116.

A second part P2 of the first set of wires 222 to 228 and the second set of wires 422 to 428 may be accommodated in the two accommodating units of the body 118, respectively. In this case, the output of the battery (not shown) may be disposed in an upper portion of the body 118, so that one end of the second part P2 of the first set of wires 222 to 228 and the second set of wires 422 to 428 may be electrically connected to the output of the battery. The second part P2 of the first set of wires 222 to 228 and the second set of wires 422 to 428 may include a bent curved portion. For example, the second part P2 is bent in z-shape, s-shape, etc., so that the tension applied to the wires 222 to 228, 422 to 428 are relieved while the two heaters 116 and 210 are moved between the open position and the closed position. With this configuration, the wires 222 to 228, 422 to 428 can be prevented from being easily worn out or disconnected.

FIG. 4B is a rear perspective view of the second heater unit 116. One end on the first part P1 of the second set of wires 422 to 428 may be electrically connected to an upper side portion of the second heater unit 116 to supply power to the second heater unit 116. Similarly, one end of the first part P1 of the first set of wires 222 to 228 may be electrically connected to an upper side portion of the first heater unit 210 to supply power to the first heater unit 210.

Figure 5:
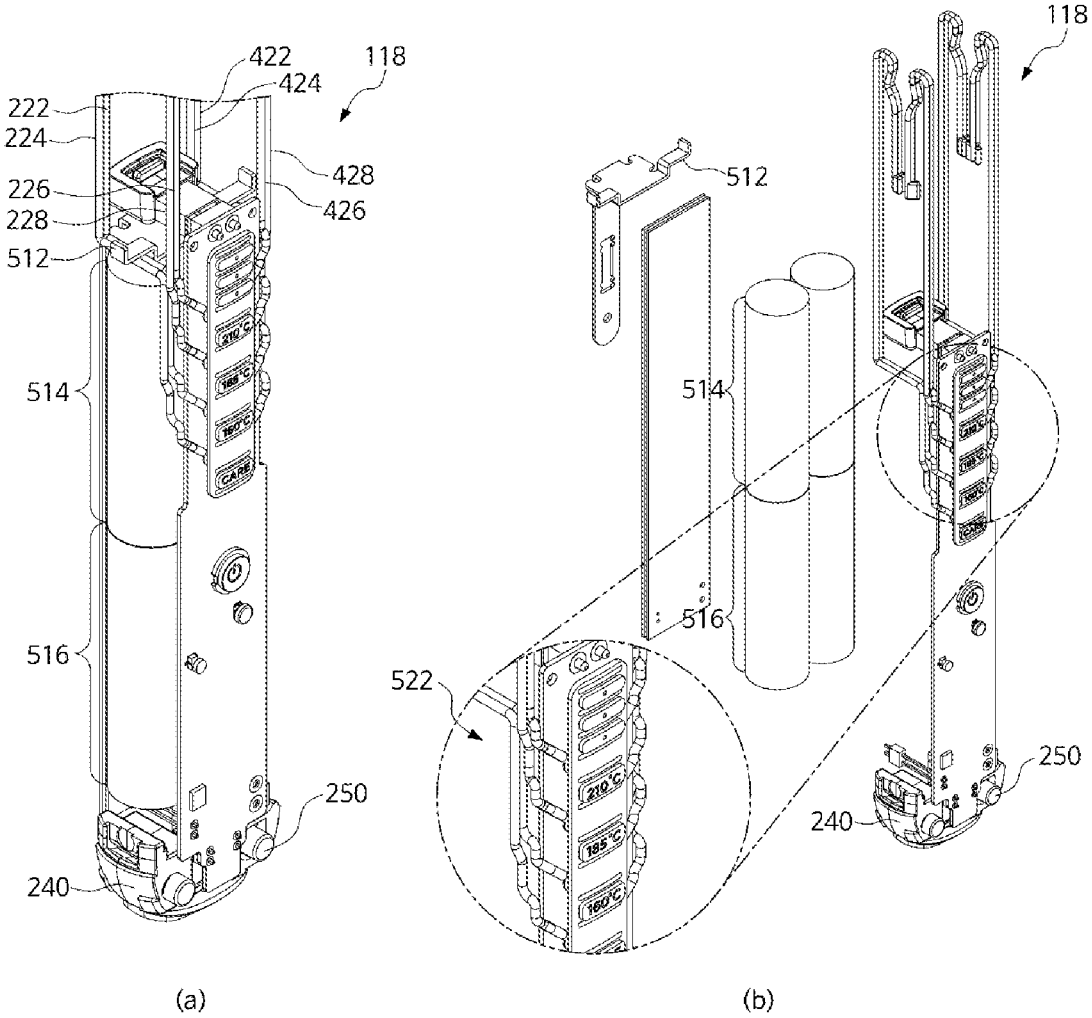
FIG. 5 are a perspective view and an exploded view of the body.

FIG. 5 are a perspective view and an exploded view of the body 118. As shown in FIG. 5A, the body 118 may include a locking member 512, batteries 514 and 516, and dual hinges 240 and 250.

The inputs of the batteries 514 and 516, which are connected to external power supply (e.g., AC power supply for charging the batteries), may be disposed in the lower portion of the body 118. Further, the outputs of the batteries 514 and 516 for supplying power to the first and second heater units may be disposed in the upper portion of the body 118. Specifically, the outputs of the batteries 514 and 516 may be disposed in the upper portion of the body 118 and electrically connected to the first and second heater units through the wires 222 to 228, 422 to 428.

As shown in FIG. 5B, the wires accommodated in the accommodating unit of the body 118 may include a curved portion 522. One wire may include a plurality of curved portions. Each of the curved portions may be formed by being curved (bent) in different directions from one another.

Figure 6:
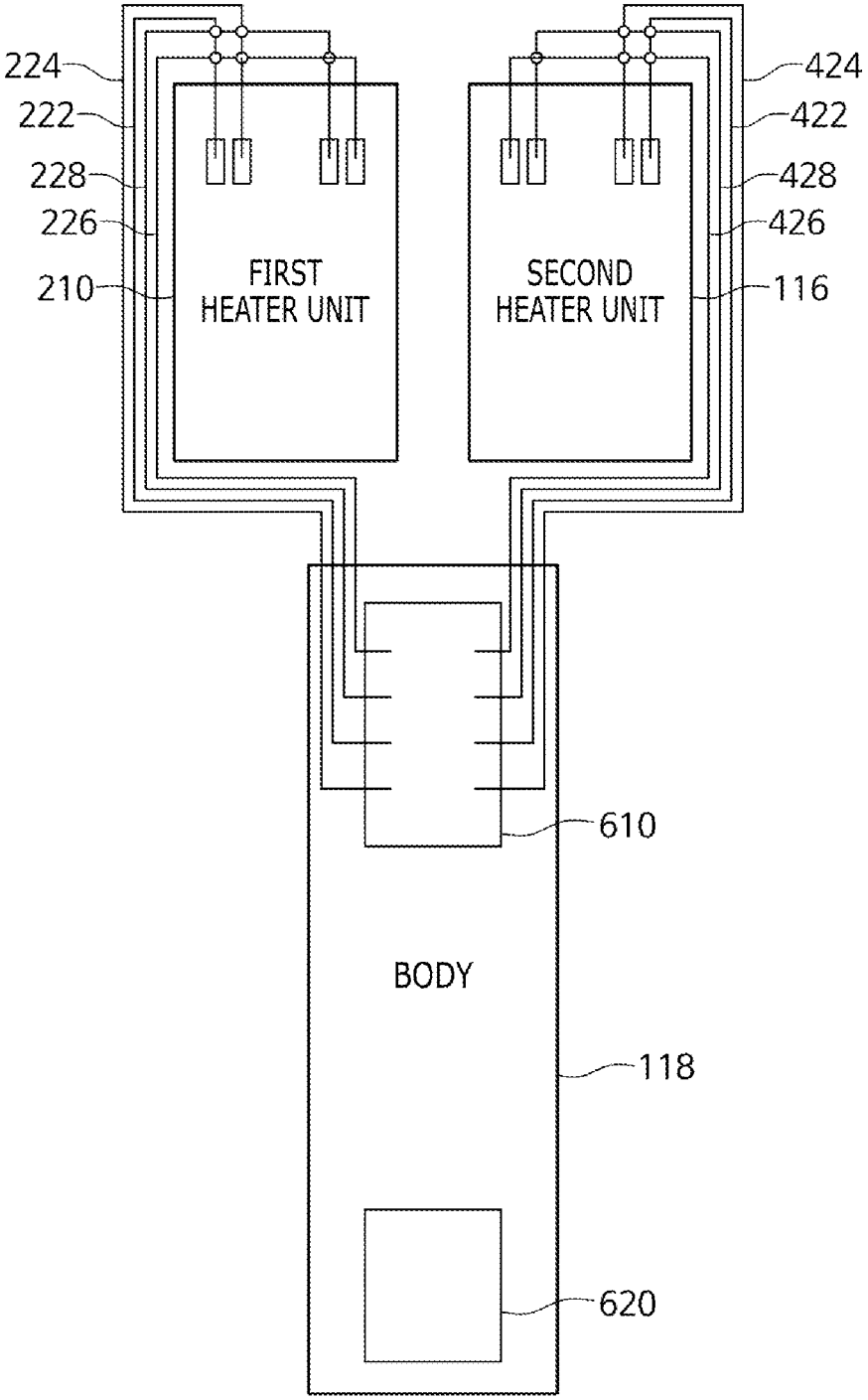
FIG. 6 is a schematic view showing a wiring structure of wires.

FIG. 6 is a schematic view showing wiring structure of the wires 222 to 228, 422 to 428. As shown, the first set of wires 222 to 228 may electrically connect the first heater unit 210 and an output 610 of the battery. Similarly, the second set of wires 422 to 428 may electrically connect the second heater unit 116 and the output 610 of the battery. Further, the output 610 of the battery may be positioned in the upper portion of the body 118, and an input 620 of the battery may be positioned in the lower portion of the body 118.

As shown, the vertical length of the body 118 is longer than that of the first heater unit 210 and the second heater unit 116. Accordingly, when the wires 222 to 228, 422 to 428 extend from the output 610 of the battery disposed in the upper portion of the body 118 toward the lower portion of the body 118, and extend back to the upper portion of the body 118 and connected to the lower side portions of the first heater unit 210 and the second heater unit 116, the length of the required internal wire is longer than that of the wires 222 to 228, 422 to 428 in FIG. 6. Since the length of the wire is proportional to the power loss, the configuration described above can minimize the power loss of the cordless hair straightener and increase use time. Further, as the volume of the wires accommodated in the body 118 decreases, the overall size of the body 118 that serves as a handle of the cordless hair straightener also decreases, thereby increasing user convenience.

Figure 7:
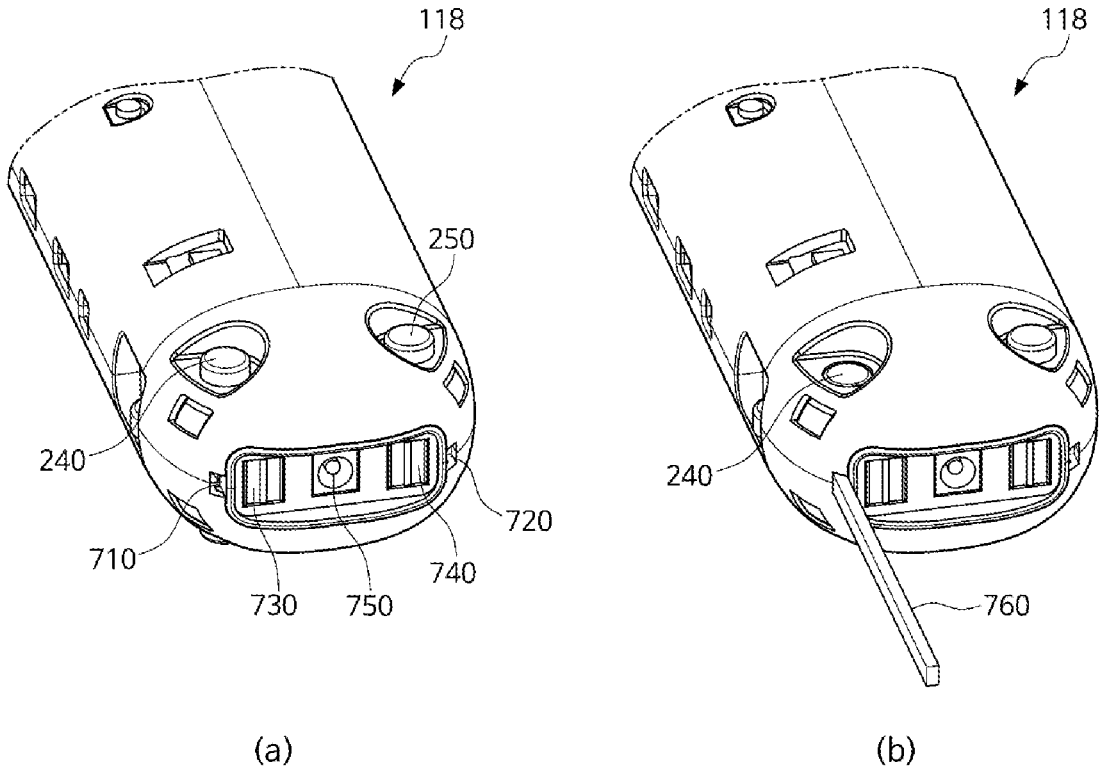
FIG. 7 shows examples of operation of a dual hinge coupled with the body.

FIG. 7 shows examples of operation of the dual hinges 240 and 250 coupled with the body 118. As shown, a lower side surface of the body 118 may include the dual hinges 240 and 250, two guide holes 710 and 720, first charging terminals 730 and 740, and a DC charging port 750. The first charging terminals 730 and 740 and the DC charging port 750 may be configured to be electrically connected to the input (not shown) of the battery located in the body 118.

FIG. 7A shows an example in which the dual hinges 240 and 250 are in protruded states. When there is no external pressure applied to the dual hinges 240 and 250, at least a part of the dual hinges 240 and 250 may be protruded externally from the body 118. Specifically, two protrusions (not shown) of each of the dual hinges 240 and 250 may be protruded in opposite directions to each other. The details of the structure of the protrusions will be described below with reference to FIG. 8.

FIG. 7 shows a state in which the first and second housings are removed, but the first and second housings may be engaged with the first hinge 240 and the second hinge 250, respectively. In this case, the protrusion of the first hinge 240 may be engaged with a fastening groove (not shown) present on an inner side surface of the first housing, thereby fixing the first housing to the body 118. Accordingly, the first hinge 240 can be prevented from being exposed to the outside of the cordless hair straightener. Similarly, the protrusion of the second hinge 250 may be engaged with a fastening hole (not shown) present on an inner side surface of the second housing, thereby fixing the second housing to the body 118.

When the lower portion of the body 118 is coupled with a charging cradle (not shown), power may be supplied to the cordless hair straightener through the first charging terminals 730 and 740. An example in which the lower portion of the body 118 is coupled with the charging cradle will be described below with reference to FIG. 15. Additionally, even when a DC charging cable (not shown) is connected to the DC charging port 750, power can be supplied to the cordless hair straightener. With the above configuration, even when the battery is not fully charged, user is able to operate the cordless hair straightener by using the DC charging cable.

FIG. 7B shows an example in which the first hinge 240 is in retracted state. When pressurizing equipment 760 is inserted along the first guide hole 710, the protrusions of the first hinge 240 may be retracted. The retraction of the protrusions of the first hinge 240 may allow the first housing to be detached and attached. Similarly, when the pressurizing equipment 760 is inserted into the second guide hole 720, the protrusions of the second hinge 250 may be retracted to allow the second housing to be detached and attached.

Figure 8:
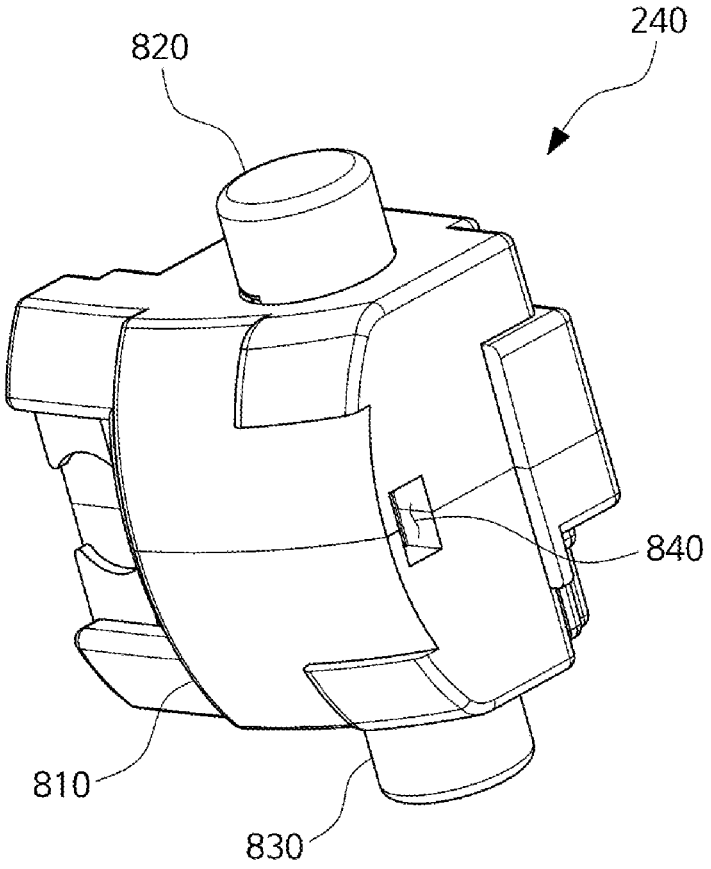
FIG. 8 is a detailed view of a first hinge.

FIG. 8 is a detailed view of the first hinge 240. As shown, the first hinge 240 may include two protrusions 820 and 830, a hinge housing 810, and a guide hole 840. The guide hole 840 may be in communication with the first guide hole 710 of the body 118 shown in FIG. 7. Although only the first hinge 240 is shown in FIG. 8, the second hinge 250 may also include two protrusions, a hinge housing, and a guide hole connected to the second guide hole 720. The first hinge 240 and the second hinge may be disposed in the body to face each other.

The hinge housing 810 may fixedly accommodate at least a part of the two protrusions 820 and 830. Accordingly, when the pressurizing equipment (not shown) is inserted into the guide hole 840 and external force is applied to the two protrusions 820 and 830 in a predetermined direction, the first protrusion 820 and the second protrusion 830 may be moved in a predetermined direction.

Figure 9:
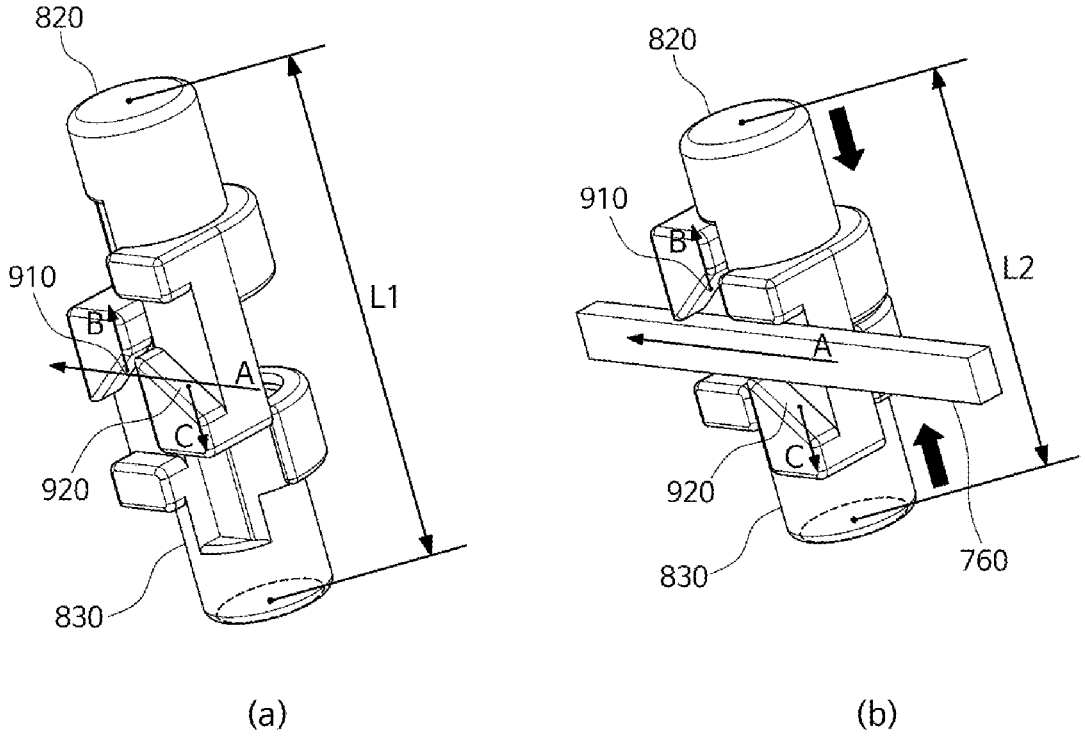
FIG. 9 are views showing a first hinge with a hinge housing removed.

FIG. 9 is a view showing the first hinge with the hinge housing removed. As shown, FIG. 9A shows an example in which external force by the pressurizing equipment 760 is not applied to the first hinge. The first protrusion 820 may have a first inclined surface 910, and the second protrusion 830 may have a second inclined surface 920. As shown, the first inclined surface 910 and the second inclined surface 920 are not in parallel. Additionally, the first protrusion 820 and the second protrusion 830 may be disposed in opposite directions on the same axis.

FIG. 9B shows an example in which the pressurizing equipment 760 applies external force in a predetermined direction A to the first inclined surface 910 and the second inclined surface 920. As shown, when external force is applied to the first inclined surface 910 and the second inclined surface 920 in the predetermined direction A, the two protrusions 820 and 830 of the first hinge may be retracted. Specifically, the first protrusion 820 may be moved in a first direction C, and the second protrusion 830 may be moved in a second direction B opposite to the first direction C. The direction A is perpendicular to the directions B and C. Accordingly, a distance between an end of the first protrusion 820 and an end of the second protrusion 830 may be reduced from L1 to L2.

As described above in FIG. 7, the two protrusions 820 and 830 of the first hinge 240 may be engaged with the fastening hole in the first housing. However, when external force is applied to the first inclined surface 910 and the second inclined surface 920 in the predetermined direction A, the two protrusions 820 and 830 may be retracted, which in turn causes the first protrusion 820 and the second protrusion 820 to be released from the fastening with the fastening hole, and the first housing may be separated from the body.

Figure 10:
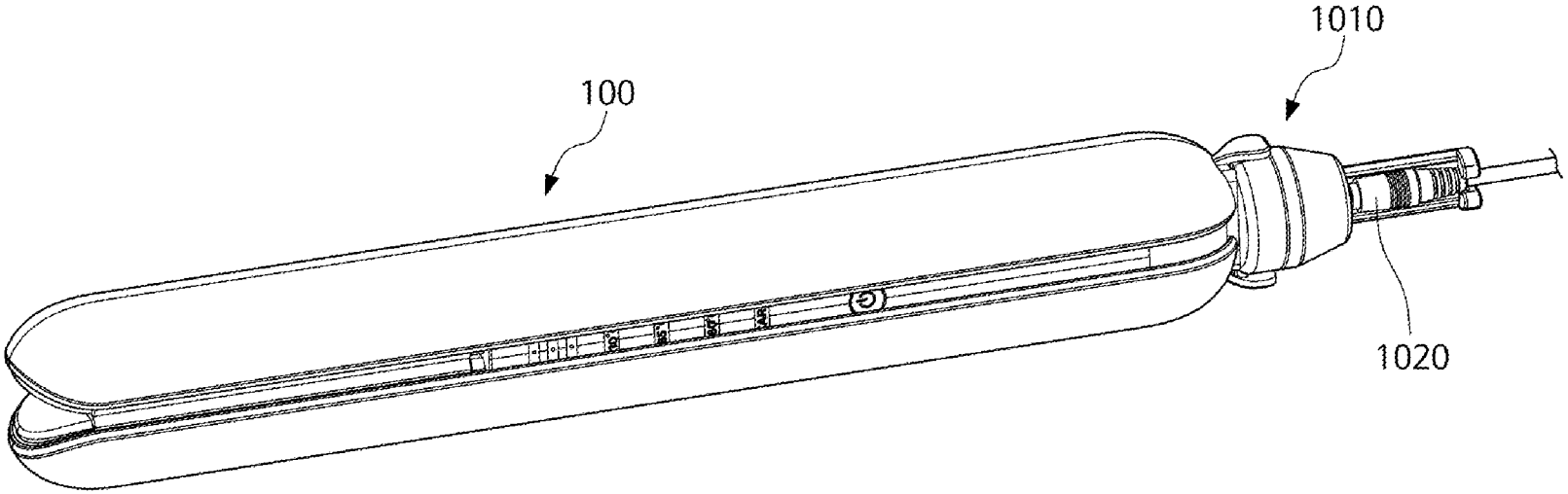
FIG. 10 shows an example in which a swivel assembly and a cable are connected to a cordless hair straightener.

FIG. 10 shows an example in which a swivel assembly 1010 and a cable 1020 are connected to the cordless hair straightener 100. The cable 1020 may supply external power supply to the cordless hair straightener 100. Further, the swivel assembly 1010 may prevent the cable 1020 from being twisted while the user uses the cordless hair straightener 100 with the cable 1020 connected. That is, when the swivel assembly 1010 is engaged with the cordless hair straightener 100, the user may use the cordless hair straightener 100 in infinite rotation without twisting the cable 1020 even when the cable 1020 is connected.

Figure 11:
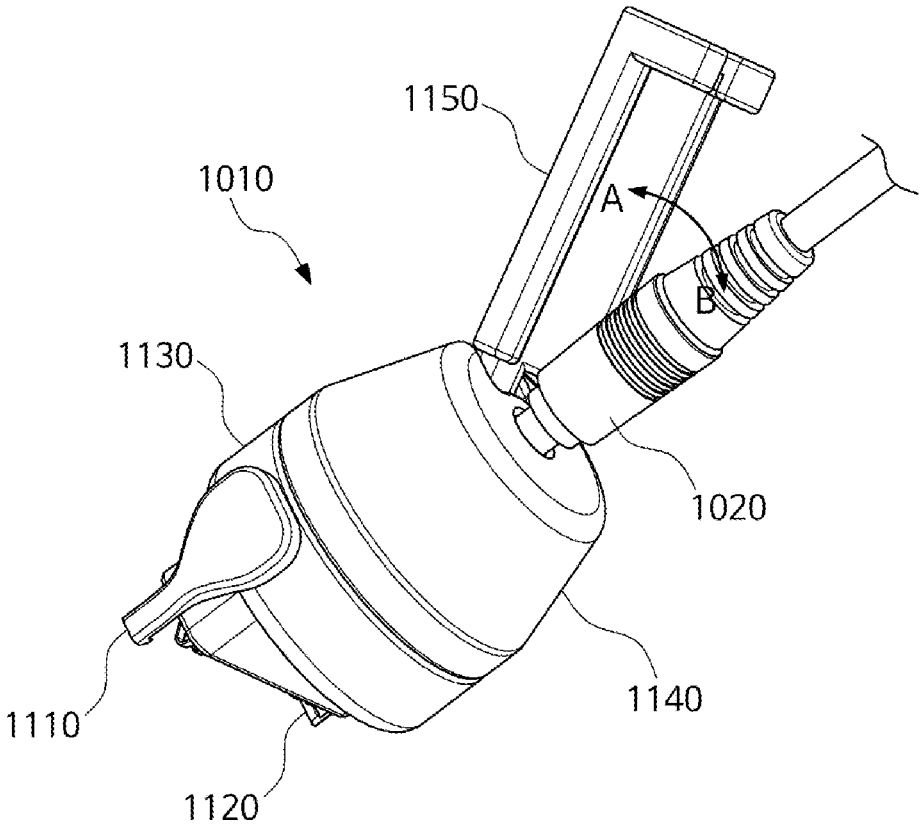
FIG. 11 shows an example of fixing a cable to a swivel assembly.

FIG. 11 shows an example of fixing the cable 1020 to the swivel assembly 1010. As shown, the swivel assembly 1010 may include an upper assembly 1130, a lower assembly 1140, and a cable fixing member 1150. Further, the upper assembly 1130 may include two locking parts 1110 and 1120. The swivel assembly 1010 may be engaged with the body as the locking parts 1110 and 1120 are fixedly coupled with the two guide holes included in the lower side surface of the body (not shown). Accordingly, the upper assembly 1130 of the swivel assembly 1010 may be fixedly coupled with the cordless hair straightener.

The cable 1020 may be coupled with the lower assembly 1140. Specifically, a terminal of the cable 1020 may be coupled with a port of the lower assembly 1140. In a state in which the cable 1020 and the lower assembly 1140 are coupled with each other, by moving the cable fixing member 1150 in a direction B, the cable 1020 may be fixed so as not to be separated from the lower assembly 1140. On the contrary, when the cable fixing member 1150 is moved again in a direction A, the cable 1020 may be separated from the lower assembly 1140. With this configuration, separation from the cable 1020 and the lower assembly 1140 or cut of the power supply can be prevented while the user uses the cordless hair straightener.

Figure 12:
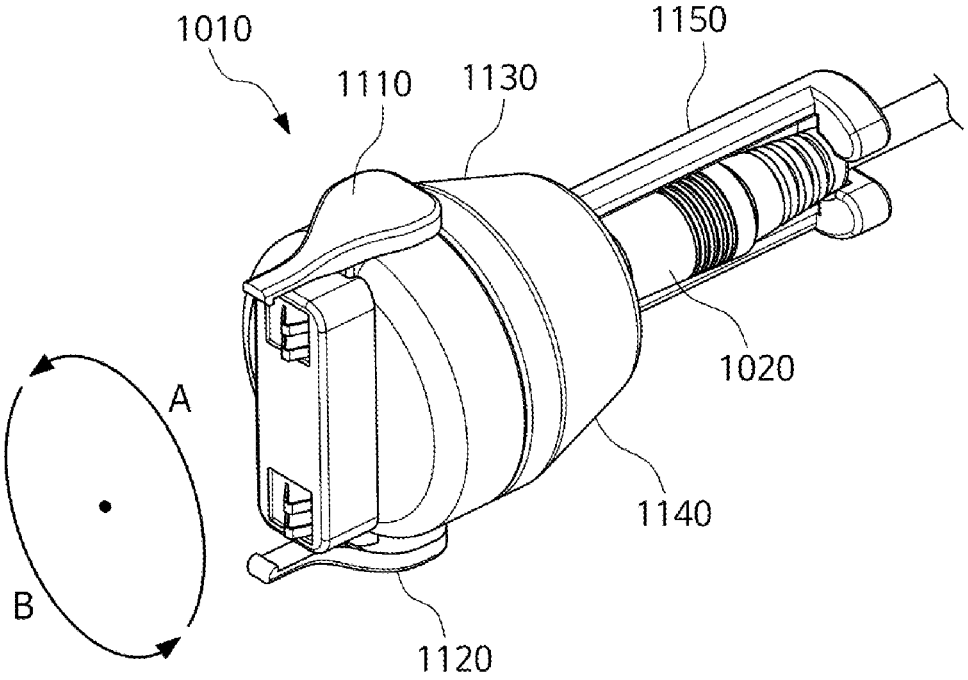
FIG. 12 shows an example of a rotation direction of the body.

FIG. 12 shows an example of rotation directions A and B. As described above, the upper assembly 1130 of the swivel assembly 1010 may be fixed to the guide holes included in the lower side surface of the body by two locking parts 1110 and 1120. Additionally, the upper assembly 1130 and the lower assembly 1140 may be configured to be rotated infinitely while maintaining electrical connection. Accordingly, the swivel assembly 1010 may electrically connect the cable 1020 and a charging terminal included in the lower side surface of the body, while allowing the body to be rotated infinitely in the direction A or B without having the cable 1020 twisted. With this configuration, even when the user uses the cordless hair straightener with the cable 1020 connected to the lower assembly 1140, it is possible to prevent the cable 1020 from being twisted.

Figure 13:
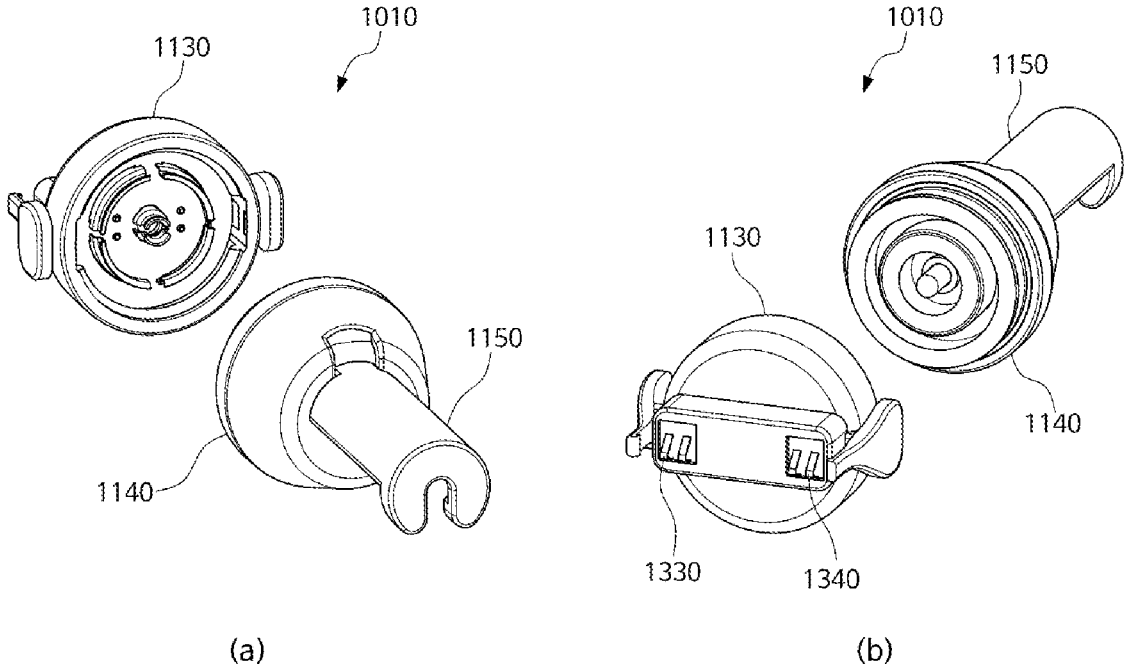
FIG. 13 are exploded views of a swivel assembly.

FIG. 13 are exploded views of the swivel assembly 1010. FIG. 13A is an exploded view in a direction of the upper assembly 1130. As shown, the cable fixing member 1150 may be hinge-coupled to the lower assembly 1140. In this case, when the cable fixing member 1150 is positioned in parallel to the rotational axis of the lower assembly 1140, the cable may be fixedly coupled with the fixing member 1050.

FIG. 13B is an exploded view in a direction of the lower assembly 1140. As shown, the lower assembly 1140 may include second charging terminals 1330 and 1340. The second charging terminals 1330 and 1340 may be electrically connected to the first charging terminals (730, 740 in FIG. 7) of the body, so that the cable and the first charging terminal of the body can be electrically connected.

Figure 14:
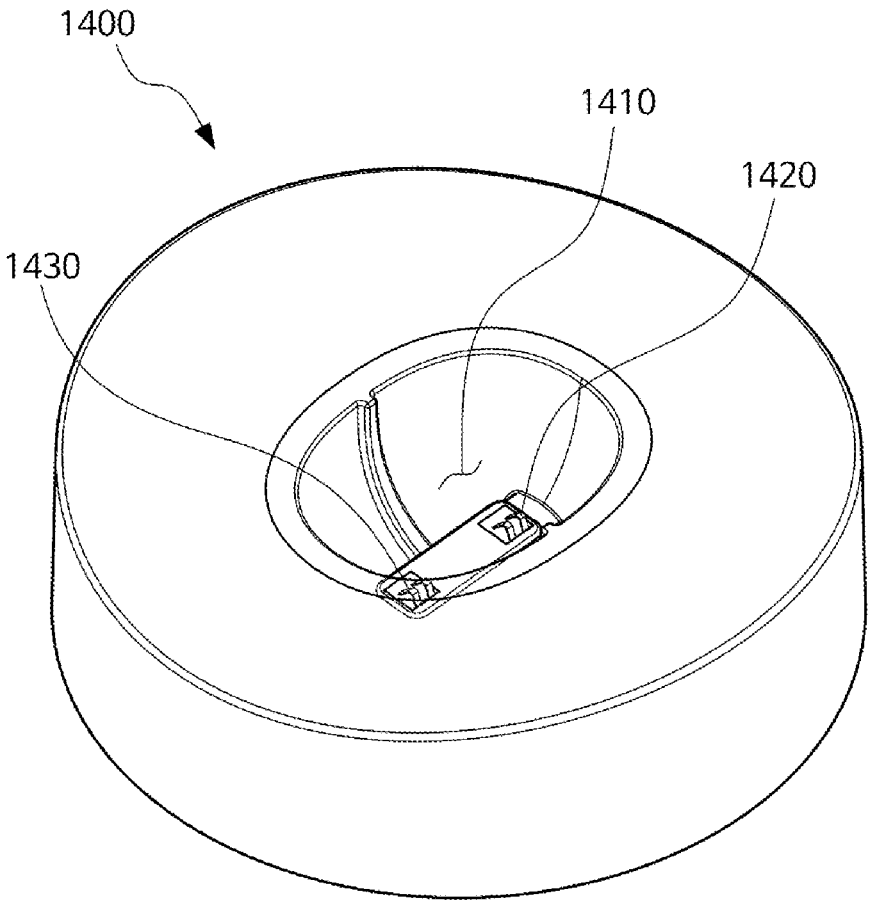
FIG. 14 is a perspective view of a charging cradle.

FIG. 14 is a perspective view of a charging cradle 1400. When the cordless hair straightener is not in use, the user may place the cordless hair straightener in the charging cradle 1400 to charge the battery of the cordless hair straightener. As shown, the charging cradle 1400 may include a holder 1410 and output terminals 1420 and 1430. In this case, the output terminals 1420 and 1430 may include spring fingers respectively.

The holder 1410 may have a recessed shape. Specifically, the holder may have a recessed shape which is the same or similar to an outer surface of the lower portion of the cordless hair straightener (or of the first housing and the second housing) so as to be fixedly held as the lower portion of the cordless hair straightener is inserted into the holder 1410. In addition, the output terminals 1420 and 1430 may be positioned in the holder 1410, so that the cordless hair straightener may be charged upon being placed on the holder 1410. With this configuration, the output terminals 1420 and 1430 may be electrically connected to the first charging terminals (730, 740 in FIG. 7) of the body, so that the cable and the first charging terminal of the body may be electrically connected. That is, the charging cradle 1400 may serve as both a holder and a charger for the cordless hair straightener. Although the cable is not connected in FIG. 14, the cable may be connected to the charging cradle 1400 to charge the cordless hair straightener.

Figure 15:
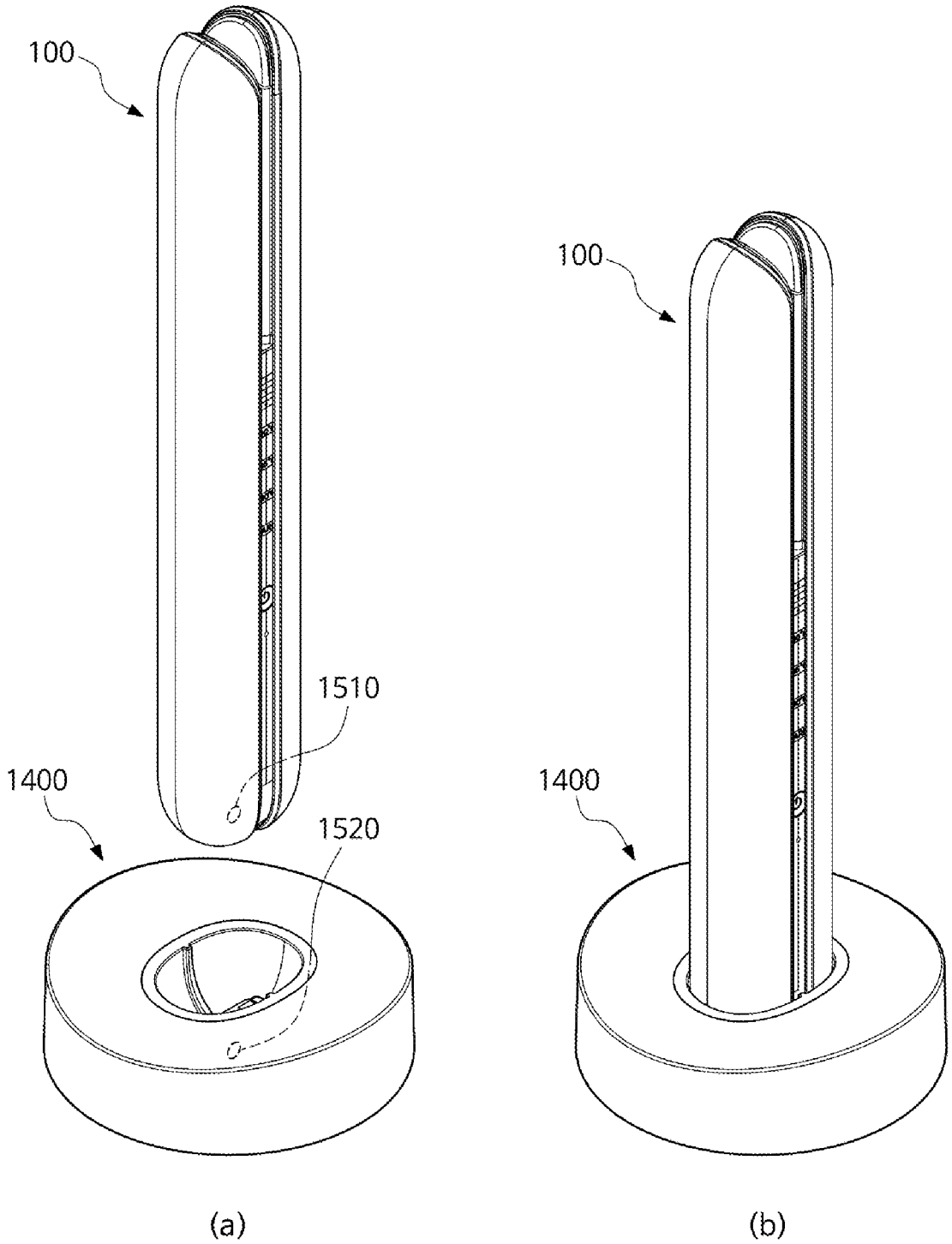
FIG. 15 shows an example in which the cordless hair straightener is mounted on the charging cradle.

FIG. 15 shows an example in which the cordless hair straightener 100 is held by the charging cradle 1400. FIG. 15A shows an example of the cordless hair straightener 100 before being held by the charging cradle 1400. The cordless hair straightener 100 may include a magnet 1510 on a lower side portion. Additionally, the charging cradle 1400 may include a hall effect sensor 1520 which detects the magnetic force of the magnet 1510. Before the cordless hair straightener 100 is held, the hall effect sensor 1520 may not detect the magnetic force of the magnet 1510 so that charging of the cordless hair straightener 100 may not start.

FIG. 15B shows an example of the cordless hair straightener 100 held by the charging cradle 1400. As shown, the lower side portion of the cordless hair straightener 100 may be held by the holder of the charging cradle 1400 to be stably fixed. Further, as the cordless hair straightener 100 is held in place, the magnet 1510 may be in proximity to the hall effect sensor 1520. Accordingly, the charging cradle 1400 may detect the magnetic force of the magnet 1510 and start charging the cordless hair straightener 100.

Figure 16:
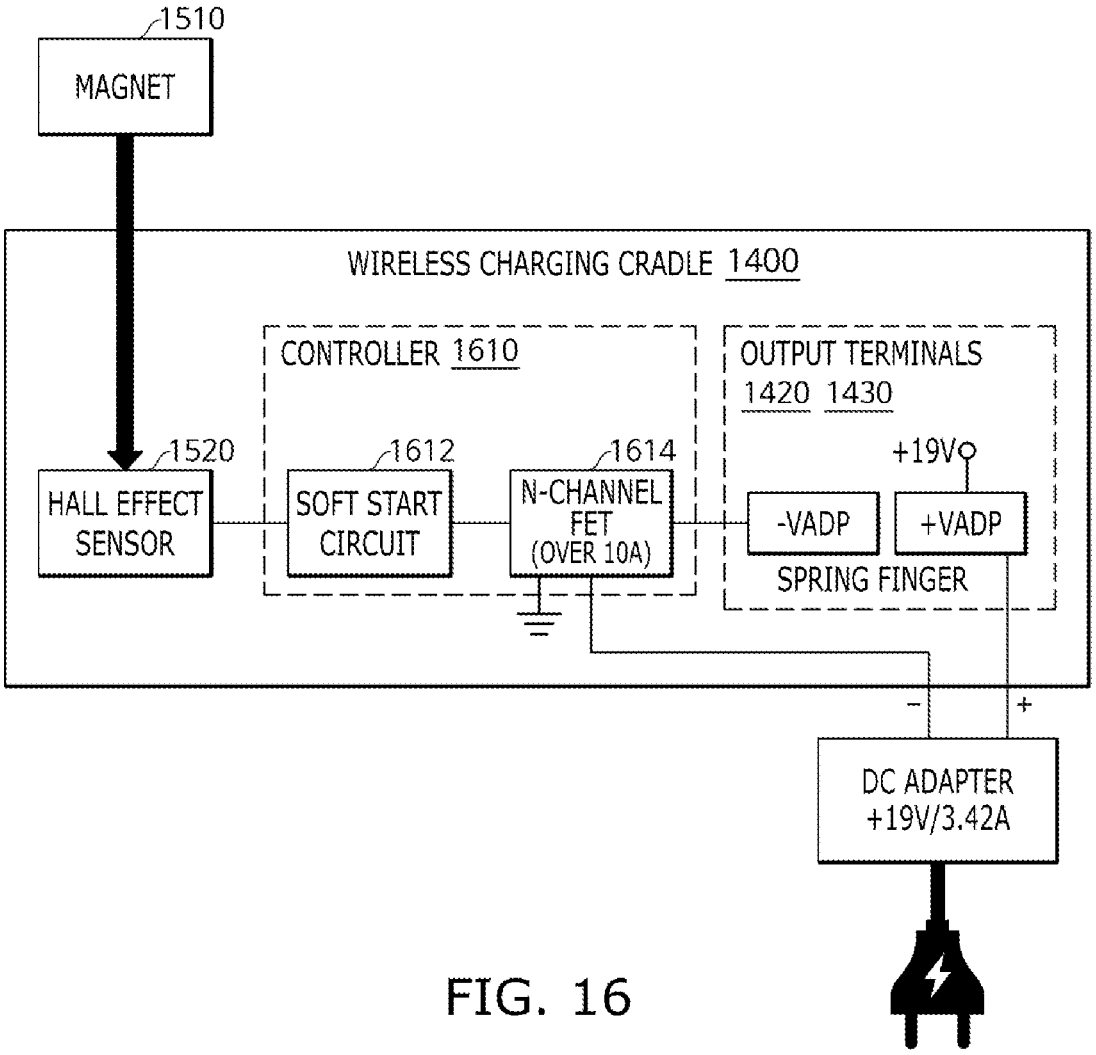
FIG. 16 is a block diagram of the charging cradle.

FIG. 16 is a block diagram of the charging cradle 1400. As shown, the charging cradle 1400 may include a hall effect sensor 1520, a controller 1610, and output terminals 1420 and 1430. In this case, the output terminals 1420 and 1430 may be configured to be electrically connected to the input of the battery of the cordless hair straightener.

The controller 1610 may include a soft start circuit 1612 and an N-channel FET 1614. The controller 1610 may control the application of external power supply to the output terminals 1420 and 1430. If the hall effect sensor 1520 does not sense the magnetic force of the magnet 1510, the controller 1610 may block external power supply from being applied to the output terminals 1420 and 1430. With this configuration, short circuits due to short of the output terminals 1420 and 1430 can be prevented. Meanwhile, if the hall effect sensor 1520 senses the magnetic force of the magnet 1510, the controller 1610 may gradually increase amount of power applied to the output terminals 1420 and 1430 through the soft start circuit 1612. With this configuration, generation of sparks in an incomplete contact state between the output terminals 1420, 1430 and the first charging terminals (730, 740 of FIG. 7) of the cordless hair straightener can be prevented.

The methods, operations, or techniques of the present disclosure may be implemented by various means. For example, these techniques may be implemented in hardware, firmware, software, or a combination thereof. Those skilled in the art will further appreciate that various illustrative logical blocks, modules, circuits, and algorithm steps described in connection with the disclosure herein may be implemented in electronic hardware, computer software, or combinations of both. To clearly illustrate this interchangeability of hardware and software, various illustrative components, blocks, modules, circuits, and steps have been described above generally in terms of their functionality.

Whether such a function is implemented as hardware or software varies according to design requirements imposed on the particular application and the overall system. Those skilled in the art may implement the described functions in varying ways for each particular application, but such implementation should not be interpreted as causing a departure from the scope of the present disclosure.

In a hardware implementation, processing units used to perform the techniques may be implemented in one or more ASICs, DSPs, digital signal processing devices (DSPDs), programmable logic devices (PLDs), field programmable gate arrays (FPGAs), processors, controllers, microcontrollers, microprocessors, electronic devices, other electronic units designed to perform the functions described in the present disclosure, computer, or a combination thereof.

Accordingly, various example logic blocks, modules, and circuits described in connection with the present disclosure may be implemented or performed with general purpose processors, DSPs, ASICs, FPGAs or other programmable logic devices, discrete gate or transistor logic, discrete hardware components, or any combination of those designed to perform the functions described herein. The general purpose processor may be a microprocessor, but in the alternative, the processor may be any related processor, controller, microcontroller, or state machine. The processor may also be implemented as a combination of computing devices, for example, a DSP and microprocessor, a plurality of microprocessors, one or more microprocessors associated with a DSP core, or any other combination of the configurations.

In the implementation using firmware and/or software, the techniques may be implemented with instructions stored on a computer-readable medium, such as random access memory (RAM), read-only memory (ROM), non-volatile random access memory (NVRAM), programmable read-only memory (PROM), erasable programmable read-only memory (EPROM), electrically erasable PROM (EEPROM), flash memory, compact disc (CD), magnetic or optical data storage devices, etc. The instructions may be executable by one or more processors, and may cause the processor(s) to perform certain aspects of the functions described in the present disclosure.

Although the present disclosure has been described in connection with some examples herein, various modifications and changes can be made without departing from the scope of the present disclosure, which can be understood by those skilled in the art to which the present disclosure pertains. In addition, such modifications and changes should be considered within the scope of the claims appended herein.

The invention claimed is:

1. A cordless hair straightener, comprising:

a body comprising a battery, wherein the battery comprises an input and an output, and wherein the battery is configured to be charged by an external power supply via the input;

a first heater electrically connected to the output of the battery;

a second heater electrically connected to the output of the battery;

a first housing accommodating at least a part of the body and at least a part of the first heater, wherein the first housing is configured to move the first heater between a first closed position and a first open position; and a second housing accommodating at least a part of the body and at least a part of the second heater, wherein the second housing is configured to move the second heater between a second closed position and a second open position, wherein the first housing is engaged with a first hinge disposed in a lower portion of the body, the second housing is engaged with a second hinge, which is different from the first hinge and disposed in the lower portion of the body, wherein the first hinge comprises:

a first protrusion having a first inclined surface; and a second protrusion having a second inclined surface, wherein the first protrusion and the second protrusion are disposed in opposite directions on a same axis, and wherein based on external force being applied to the first inclined surface and the second inclined surface in a predetermined direction, the first protrusion is configured to be moved in a first direction, and the second protrusion is configured to be moved in second direction opposite to the first direction, allowing the first housing to be attached to the body or detached from the body.

2. The cordless hair straightener of claim 1, wherein:

the first housing is configured to be rotatable around the first hinge between the first closed position and the first open position; and the second housing is configured to be rotatable around the second hinge between the second closed position and the second open position.

3. The cordless hair straightener of claim 2, wherein the first hinge is accommodated in the first housing and is not exposed to an outside of the first housing, and wherein the second hinge is accommodated in the second housing and is not exposed to an outside of the second housing.

4. The cordless hair straightener of claim 1, wherein the body comprises a guide hole on a lower side surface of the body, and based on a pressurizing equipment being inserted along the guide hole, the first and second protrusions of the first hinge are configured to be retracted, allowing the first housing to be attached to the body or detached from the body.

5. The cordless hair straightener of claim 1, further comprising a swivel assembly configured to be connected to a cable that supplies external power, wherein:

the body comprises a guide hole and a charging terminal on a lower side surface of the body, the swivel assembly is fixedly coupled to the body through the guide hole, and the swivel assembly electrically connects the cable and the charging terminal, while allowing an infinite rotation of the body without twisting the cable.

6. The cordless hair straightener of claim 5, wherein the swivel assembly comprises:

an upper assembly fixedly coupled to the body, a lower assembly coupled to the cable, and a cable fixing member fixing the cable so as not to be separated from the swivel assembly.

7. The cordless hair straightener of claim 1, further comprising:

a magnet disposed in a lower portion of the body; and a charging cradle comprising:

a hall effect sensor;

an output terminal configured to be electrically connected to the input; and a controller configured to control external power supply to the output terminal.

8. The cordless hair straightener of claim 7, wherein the controller of the charging cradle is configured to:

based on the hall effect sensor not sensing magnetic force of the magnet, block the external power supply to the output terminal so as to prevent a short circuit associated with the output terminal; and based on the hall effect sensor sensing the magnetic force of the magnet, apply the external power supply to the output terminal.

9. The cordless hair straightener of claim 8, wherein the controller of the charging cradle is further configured to:

based on the hall effect sensor sensing the magnetic force of the magnet, gradually increase amount of power applied to the output terminal, thereby preventing a generation of spark in an incomplete contact state.

10. The cordless hair straightener of claim 1, wherein a first elastic member is disposed between the first housing and the body, and wherein a second elastic member is disposed between the second housing and the body.

11. The cordless hair straightener of claim 1, further comprising:

a first wire electrically connecting the output of the battery to the first heater; and a second wire electrically connecting the output of the battery to the second heater.

12. The cordless hair straightener of claim 11, wherein:

the input of the battery is disposed in a lower portion of the body, and the output of the battery is disposed in an upper portion of the body, the first heater is disposed so that at least a part of a lower side surface of the first heater faces at least a part of an upper side surface of the body, the second heater is disposed so that at least a part of a lower side surface of the second heater faces at least a part of an upper side surface of the body, one end of the first wire is connected to the output of the battery, and the other end of the first wire is connected to an upper side portion of the first heater, and one end of the second wire is connected to the output of the battery, and the other end of the second wire is connected to an upper side portion of the second heater.

13. The cordless hair straightener of claim 11, wherein at least a part of the first wire is located between the first housing and the first heater, and wherein at least a part of the second wire is located between the second housing and the second heater.

14. The cordless hair straightener of claim 13, wherein the first heater comprises a first recess in which the first wire located between the first housing and the first heater is disposed, and wherein the second heater comprises a second recess in which the second wire located between the second housing and the second heater is disposed.

15. The cordless hair straightener of claim 14, wherein the body comprises a first accommodating part accommodating at least a part of the first wire and a second accommodating part accommodating at least a part of the second wire, and wherein the first accommodating part and the second accommodating part are formed in an upper portion of the body.

16. The cordless hair straightener of claim 15, wherein the at least the part of the first wire accommodated in the first accommodating part comprises at least one bent curved portion so as to prevent disconnection of the first wire while the first heater is moving between the first closed position and the first open position, and wherein the at least the part of the second wire accommodated in the second accommodating part comprises at least one bent curved portion so as to prevent disconnection of the second wire while the second heater is moving between the second closed position and the second open position.

17. The cordless hair straightener of claim 15, wherein:

the at least the part of the first wire accommodated in the first accommodating part comprises a plurality of first bent curved portions so as to prevent disconnection of the first wire while the first heater is moving between the first closed position and the first open position; the plurality of first bent curved portions are formed by being bent in different directions, respectively;

the at least the part of the second wire accommodated in the second accommodating part comprises a plurality of second bent curved portions so as to prevent disconnection of the second wire while the second heater is moving between the second closed position and the second open position; and the plurality of second bent curved portions are formed by being bent in different directions, respectively.

* * * * *